United States Patent [19]

Johnson et al.

[11] Patent Number: 4,895,204

[45] Date of Patent: Jan. 23, 1990

[54] TUBE SUPPORT VIBRATION SUPPRESSION DEVICE AND METHOD

[75] Inventors: Robert H. Johnson, Budd Lake; Benjamin C. Ezra, Livingston; John Polcer, Brookside, all of N.J.

[73] Assignee: Foster Wheeler Energy Corporation, Clinton, N.J.

[21] Appl. No.: 138,502

[22] Filed: Dec. 24, 1987

[51] Int. Cl.[4] ..... F28F 9/00

[52] U.S. Cl. ..... 165/162; 122/510; 376/285

[58] Field of Search ..... 165/69, 162; 376/285; 122/510

[56] References Cited

U.S. PATENT DOCUMENTS

| | | | |
|---|---|---|---|
| 3,503,440 | 3/1970 | Romanos | 165/162 |
| 3,575,236 | 4/1971 | Romanos | 165/162 |
| 4,429,739 | 2/1984 | Gentry et al. | 165/159 |
| 4,624,304 | 11/1986 | Hayes | 165/162 |
| 4,633,940 | 1/1987 | Gentry et al. | 165/159 |
| 4,640,342 | 2/1987 | Appleman | 165/69 |

*Primary Examiner*—John Rivell
*Assistant Examiner*—Allen J. Flanigan
*Attorney, Agent, or Firm*—Marvin A. Naigur

[57] ABSTRACT

A device and method for augmenting support and suppressing vibration for U-bend tubes and tube spacer supports in a vapor generator vessel. The device is installed in the vapor generator vessel from outside the vessel through dual oppositely oriented openings cut through the wall and inner shroud of the generator vessel. The device extension rods are inserted through one of the openings, and the vibration suppressor blades are each inserted sequentially through the other opening and installed on a support rod and then rotated upwardly into place between the parallel tube batwing spacer supports by using a special push/twist tool, after which the support rod is indexed forward to provide positive engagement between the rod and blade, such as by a rod key and blade slot means. The suppressor blades are retained in place on the step block and rod by a clamp block attached to the step block, and the vessel dual openings are then covered by pressure-tight flange plates.

6 Claims, 5 Drawing Sheets

TUBE SUPPORT VIBRATION SUPPRESSION DEVICE AND METHOD

BACKGROUND OF INVENTION

This invention relates to vibration suppression for tube and tube supports in large vapor generators. It particularly relates to a device for suppressing vibrations in spacer supports for the upper end of U-tubes in large steam generators used in pressurized water reactor nuclear power plants.

Large shell and tube type heat exchangers have been developed for generating pressurized vapor, by passing a heated fluid through the tubes to heat and vaporize a liquid that is circulated around the tubes. The tubes are provided as many layers of U-shaped tubes, the ends of which are attached to a tubesheet usually located at the shell lower end. Because the tubes are usually relatively long, the other or upper end of the tube legs is usually susceptible to flow-induced or mechanicall-induced vibrations, and tube spacer means have been provided between the tubes to control or eliminate such tube vibrations. However, it has been found that many pressurized water reactor nuclear power plants containing U-tube steam generators have tube vibration and wear problems involving the tube support diagonal spacer strips commonly called "batwings" used therein. These problems are caused by shell side flow-induced vibration of the batwings spacer strips. When stiffness of the batwing spacer strips is inadequate, the batwings vibrate under steam flow conditions, which causes excessive wear of tube walls and has a potential for failure of the batwing spacer supports. However, because access to the batwings within the steam generator is extremely limited, it is necessary to perform any repair operations from outside the vessel, in order to minimize exposure of personnel to radiation (ALARA) and also minimize expense of the repair.

The prior art has recognized problems of tube vibrations in heat exchangers and has provided some arrangements for stabilizing the vibration of such tubes in heat exchangers. For example, U.S. Pat. No. 3,400,758 to Lee discloses multiple parallel baffle means for sequentially supporting tubes in heat exchangers. U.S. Pat. No. 3,575,236 to Romanos discloses an anti-vibration tube spacer structure disposed between adjacent layers of U-shaped tubes in shell and tube type heat exchangers. U.S. Pat. No. 4,453,501 to Hayes et al discloses a means for testing from outside a vessel whether a heat exchanger tube is locked into a tube support. Also, U.S. Pat. No. 4,503,903 to Kramer discloses a tubesheet radial support device for heat exchangers. However, the known prior art has apparently not provided a mechanism and procedure for providing support for spacer strips located between tubes in vapor generators, particularly for supports adapted to be installed from outside the vessel.

Accordingly, a tube support vibration suppressor device has now been developed which can be installed and secured to the tube supports from outside the vapor generator vessel. The tube vibration suppressor device has adequate stiffness to stiffen the tube supports, such that vibrations and associated tube wear are reduced to acceptable low levels. The suppressor device is mechanically secured within the vessel, and its method of installation requires cutting two openings in the vessel shell and shroud at the proper opposite locations, inserting the vibration suppressor device parts through the openings, and then securing the parts in place between the adjacent tube spacer supports.

SUMMARY OF INVENTION

This invention provides a tube support vibration suppression system and method for installing a vibration suppression assembly or device device on diagonal tube support structures or batwings used between laterally spaced elongated leg portions of multiple tubes in large vapor generators, and particularly for steam generators in nuclear power plants. This tube support and vibration suppression device can be advantageously installed and secured to the tube diagonal spacer support structures from outside the vapor generator vessel. The device will adequately stiffen the tube supports and reduce their natural frequency for vibration, such that support vibration and associated tube wear are either reduced to acceptable low levels or eliminated at minimal cost without major rebuilding of the vapor generator.

The tube support stiffener device according to the present invention includes dual nozzle/flanges attached pressure-tightly onto opposite sides of the vessel and in horizontal alignment with each other. A guide block unit is installed in a first nozzle/flange, unit having dual a step block and elongated keyed support rods is inserted in the guide block and extend into the vessel interior at a level below the batwing spacer supports for the tubes. A plurality of support blades are placed onto each keyed rod and then oriented upwardly to a position between the existing spacer support structures or batwings. The support blades are retained in position on the rod by a clamp block which is inserted through a second opening in the vessel wall, and positioned against the step block unit, and the opening covered by a second nozzle/flange and a blind flange.

The tube support stiffener device is installed in the vapor generator vessel from outside the vessel, by a method including first cutting two openings in the generator vessel shell and adjacent internal shroud at opposite sides of the vessel at a level below the tube supports. A first nozzle/flange unit is welded onto one first opening, and a guide block unit including dual elongated support rods are inserted therein. Next, the vibration suppressor device blade parts are inserted sequentially through the other or second openings and are installed onto the support block and extension rods within the generator vessel shell using a special rotation tool. Then, the blade parts are each rotated sequentially outwardly and upwardly to their desired angle and position between adjacent batwing spacer supports by using the special rotation tool operated from outside the vessel, and then the rods are each indexed forward so that locking means such as a key and slot are engaged between each extension rod and suppressor blade part.

By this invention, the diagonal supports for multiple U-tubes in steam generators of pressurized water nuclear reactors are advantageously stiffened and stabilized by working from outside the generator vessel to install supplemental suppressor blades between the adjacent diagonal supports, without substantial dismantling and reconstruction of the generator. The use of this invention thereby saves considerable plant outage time and costs for such generators.

BRIEF DESCRIPTION OF DRAWINGS

The invention will be described further with reference to the following drawings, in which.

DESCRIPTION OF INVENTION

Figure 1:
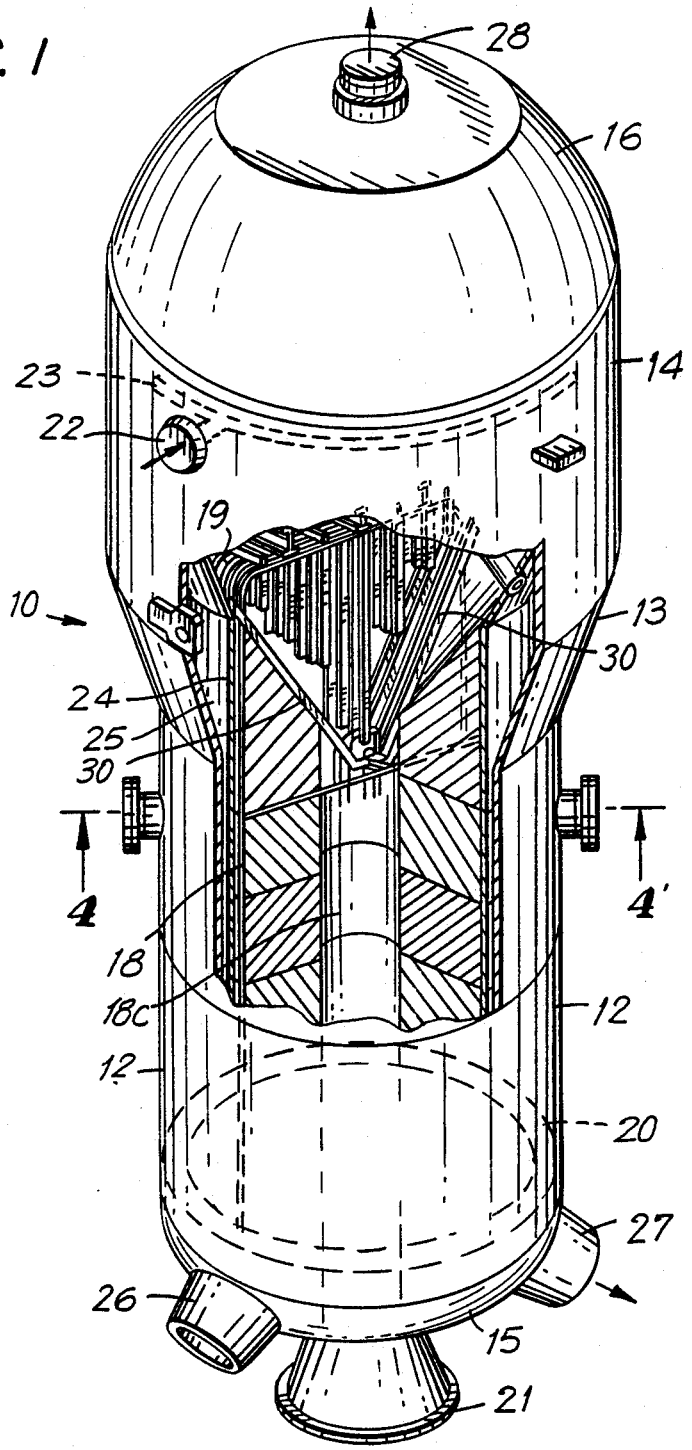
FIG. 1 shows a perspective elevation view of the essential elements of the invention including a steam generator vessel containing multiple U-shaped tubes, which are laterally supported at their upper end by multiple diagonally extending spacer supports or batwings.

As generally shown by FIG. 1, steam generator 10 includes a pressurizable elongated vertical vessel having a lower cylindrical shell portion 12 and an enlarged diameter cylindrical upper shell portion 14 which is attached to the lower portion 12 by a frustoconical transition piece 13. The vessel lower end is closed by dished head 15 attached to shell portion 12, and the vessel upper end is closed by dished head 16 attached to shell portion 14. The vessel 10 contains a large number of parallel U-shaped heat exchanger tubes 18, provided as a tube bundle of 10,000–50,000 U-bend tubes connected to a plate or tubesheet 20 located in lower shell portion 12. The U-tube outside diameter may be between 0.625 and 1.25 inch, with 0.75–1.0 inch diameter tubes usually being preferred.

A feed water inlet nozzle is provided at 22 in upper shell portion 14 and is connected to a flow distributor ring 23, which distributes the feed water flow downwardly through annular space 25 between a cylindrical shroud 24 provided and the shell 12 towards the vessel tubesheet 20. Inlet nozzle 26 provided in lower head 15 carries a hot fluid into the uprising leg **18*a* of the heat exchanger tubes 18, while outlet nozzle 27 removes the cooler outlet fluid from downflowing leg 18*b* of the tubes. The heat content of the inlet fluid entering at nozzle 26 vaporizes the feed water introduced at inlet nozzle 22 to generate pressurized steam, which exits the vessel at nozzle 28 provided in upper head 16**.

Figure 2:
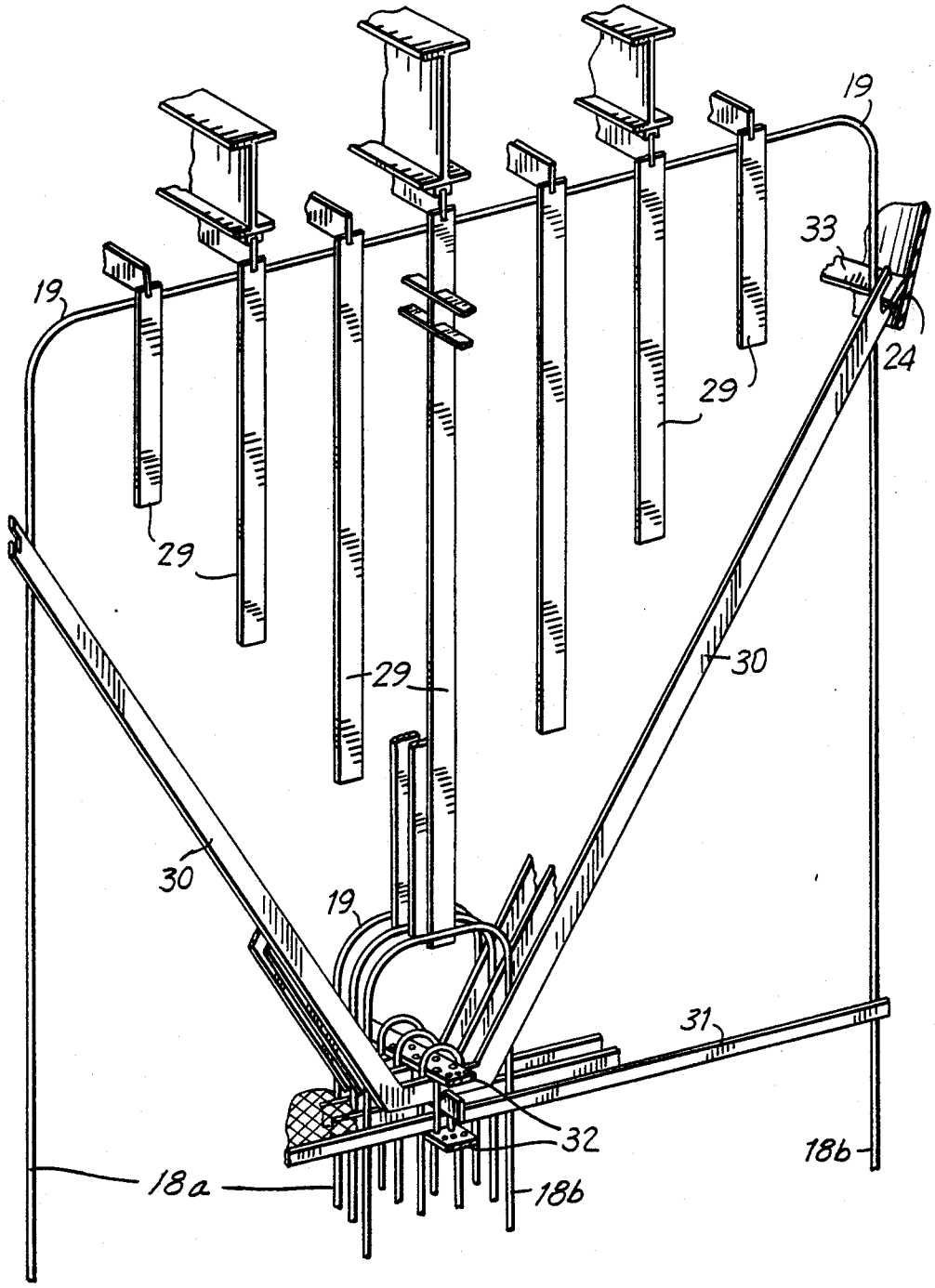
FIG. 2 shows an enlarged partial perspective view of the upper portion of the U-shaped tubes and diagonal tube spacer supports or batwings.

As generally shown by FIG. 2, the upper portion 19 of each of the U-bend tubes 18 is stabilized against either flow-induced or mechanically-induced vibrations by a plurality of vertically-oriented spacers 29. The tubes 18 are also supported and stabilized by diagonally upwardly oriented parallel spacer support structures 30 called batwings, extending upwardly between the parallel rows of tubes 18. The batwings are supported at their lower ends by a horizontal support structure 32, which is rigidly attached to the inner walls of lower shell portion 12. The batwing supports 30 each extends diagonally upwardly between adjacent rows of tubes 18 near their bends 19, and are attached to upper support bar 33 and cylindrical shroud 24 so as to stabilize the tubes, as is shown in greater detail in FIG. 2. The tubes 18 are thus supported by the plurality of diagonal oriented batwing spacer supports 30, which extend between adjacent rows of the tubes and serve to laterally support and stabilize the tubes at their upper ends against induced vibrations within the vessel. The batwing support thickness is generally equal to the spacing between adjacent tube 18 rows, and usually varies between about 0.090 and 0.150 inch. However, it has been found that oftentimes these parallel batwing spacer supports 30 themselves vibrate and rub against the adjacent tubes 18 and cause wear damage to the tubes. Accordingly, the installation of additions vibration suppressor blade structures for the batwing spacer supports is needed, and should be accomplished without requiring substantial dismantling and outage time for the vapor generator 10.

Figure 3:
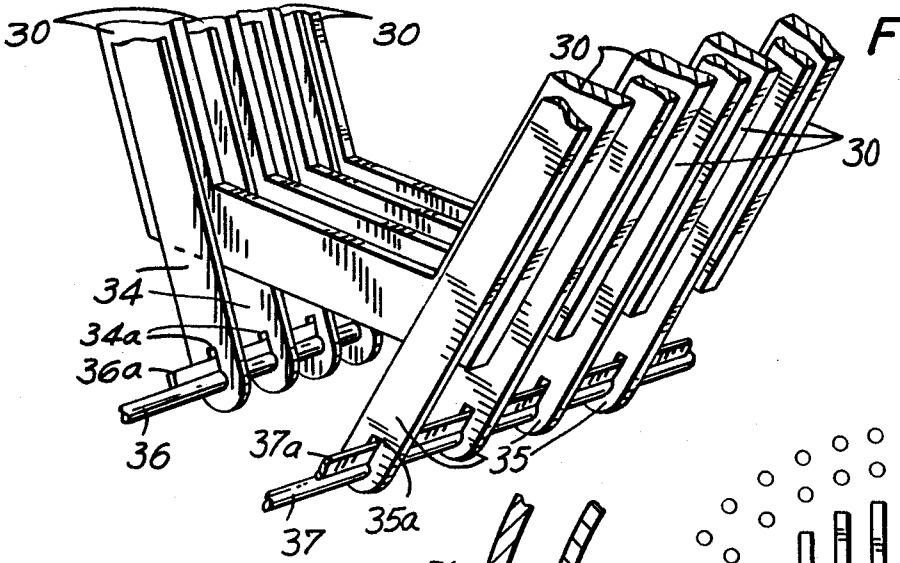
FIG. 3 shows a detailed partial perspective view of the batwing spacer supports lower portion, with a suppressor blade installed between adjacent diagonal spacer supports.

According to the invention, the diagonal upwardly oriented tube support batwing structures 30 are effectively stabilized against flow-induced or mechanically induced vibrations by providing a plurality of auxiliary supports or suppressor blades 34, 35 which are remotely placed against and between the adjacent batwing spacer support structures 30, as is generally shown by FIG. 3. The suppressor blades 34, 35 are provided in two sets and are rotatably supported on dual horizontal parallel extension rods 36 and 37 containing elongated keys **36*a* and 37*a*, respectively, and which are rigidly supported from the vessel walls 12 as described hereinbelow. The shape and thickness of the suppressor blades 34, 35 are selected so as to stiffen and stabilize the diagonal supports 30** against any induced vibrations in the supports.

Figure 4:
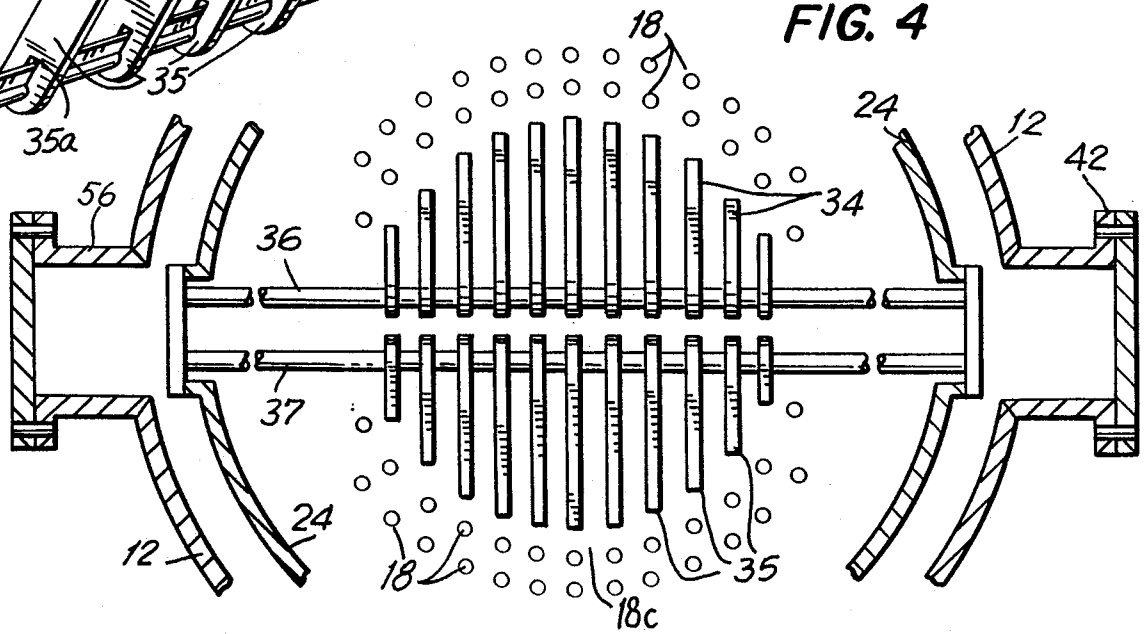
FIG. 4 is a partial plan sectional view taken at line 4—4 of FIG. 1 and showing the suppressor blades location in a central vertical opening in the tube bundle.

The location of the plurality of parallel suppressor blades 34, 35 in a central opening **18*c* in the bundle of tubes 18 and supported on rods 36 and 37 is also generally shown by FIG. 4. It is seen that the suppressor blades 34, 35 which are installed in the central portion of vertical opening 18*c* in the tube bundle 18 have lengths greater than for the blades installed nearer the sides of opening 18*c*. These spacer suppressor blade structures are installed from outside the generator vessel 12** by using a special installation procedure disclosed hereinbelow.

The number of suppressor blades 34, 35 provided on each support rod 36, 37 will depend on the number of U-tubes, but will usually be 20–50 blades. The thickness of the suppressor blades varies between about 0.625 and 1.25 inch, and their length can vary from about 6–30 inches with 10–20 inch blade length usually being preferred. If desired, the suppressor blades 34, 35 can have central openings cut therein to reduce weight of the blades, and also thereby reduce the required structural strength of the blade support rod numbers 36, 37. Useful materials for the suppressor blades include carbon steel, alloy steels and stainless steel.

Figure 5:
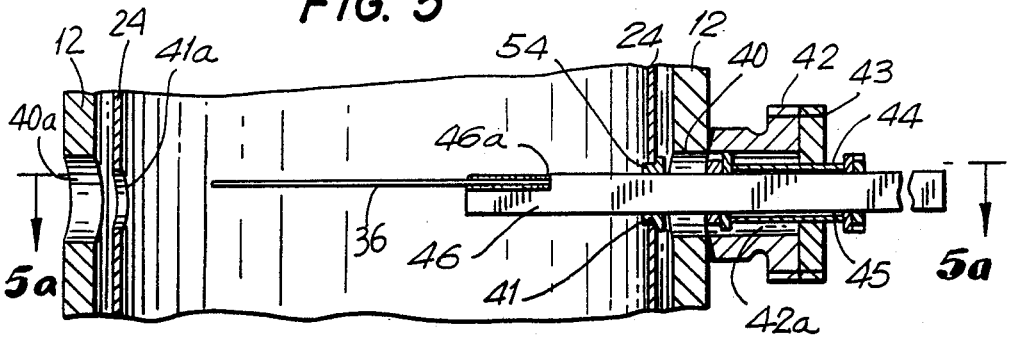
FIG. 5 shows a partial vertical sectional view of the vessel, showing a nozzle/flange and guide block unit attached to the vessel wall and a step block and keyed guide rod installed therein.
Figure 5A:
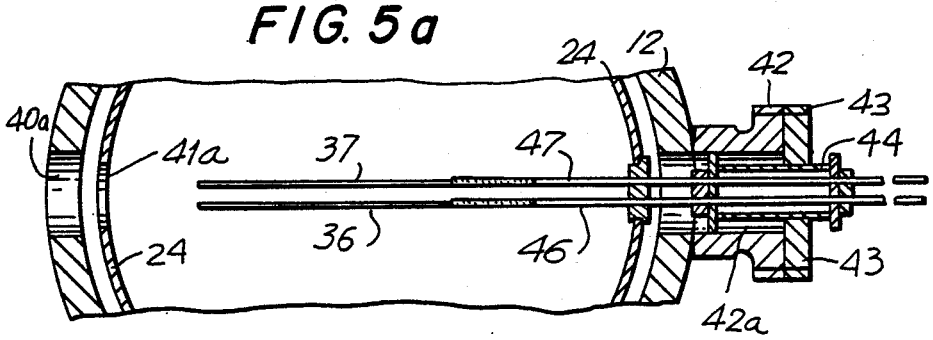
FIG. 5*a* shows a horizontal sectional view taken at line 5*a*—5*a* of FIG. 5 and showing dual step blocks and keyed guide rods.

The various structural parts of the tube support vibration suppressor elements of this invention will be further understood from a description of the method steps used for installing the parts within the vapor generator vessel 10. Referring now to FIGS. 5 and 5*a*, as a first step two diametrically opposite openings 40 and 40*a* are cut through the vessel wall 12, and openings 41 and 41*a* are cut through the inner shroud 24 at a level about 1–1.5 ft. below the lower end of the batwing spacer supports 32, so as to provide adequate access to the four vessel interior. Each of the openings must have a diameter sufficient to permit convenient installation of the vibration suppressor device parts, and each opening is usually made 10–16 inches diameter. Then, a nozzle/-flange 42 having a central bore 42*a* is sealably welded onto the vessel wall 12 concentrically around the first opening 40. A shroud sleeve 54 is then welded in place in the shroud opening 41 of shroud 24. A guide block unit 44 is inserted into bore 42*a* of the nozzle/flange 42, and bore 42*a* is sealably closed by flange 43 bolted onto the outer face of nozzle/flange 42.

Next, a step block unit including dual step blocks 46 and 47 each containing an elongated keyed guide rod 36 and 37 respectively are inserted into the vessel 10 through a central passageway 45 in the buide block unit 44. The keyed guide rods 36 and 37 extend into the central interior portion 18*c* of the generator vessel below the batwing supports 30 and their support structure 32, in which location the batwing suppressor blades 34 and 35 are to be installed, as is shown more accurately by FIGS. 5 and 5*a*.

Figure 6:
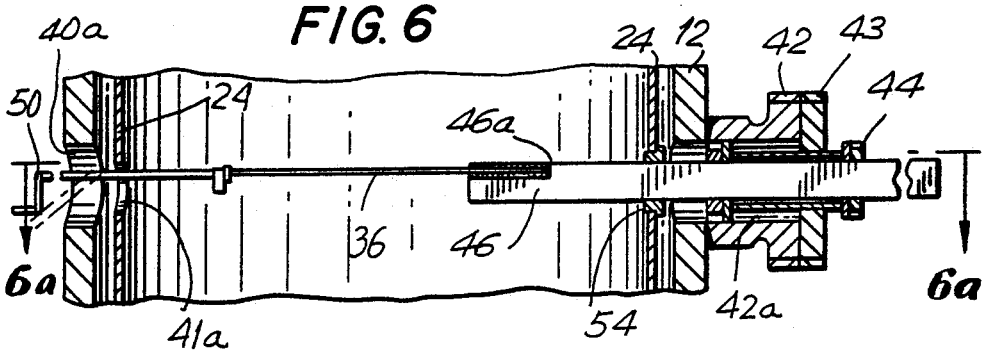
FIGS. 6 and 6*a* show further partial vertical and horizontal sectional views of the vessel and a tool used for installing suppressor blades onto the dual extension rods within the vessel.
Figure 6A:
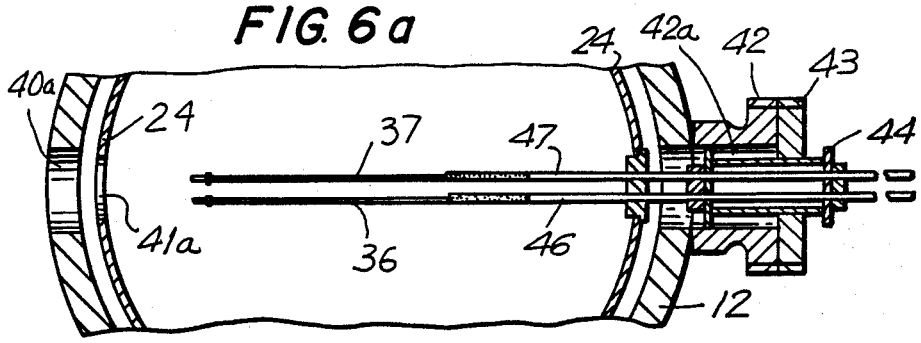
Figure 7:
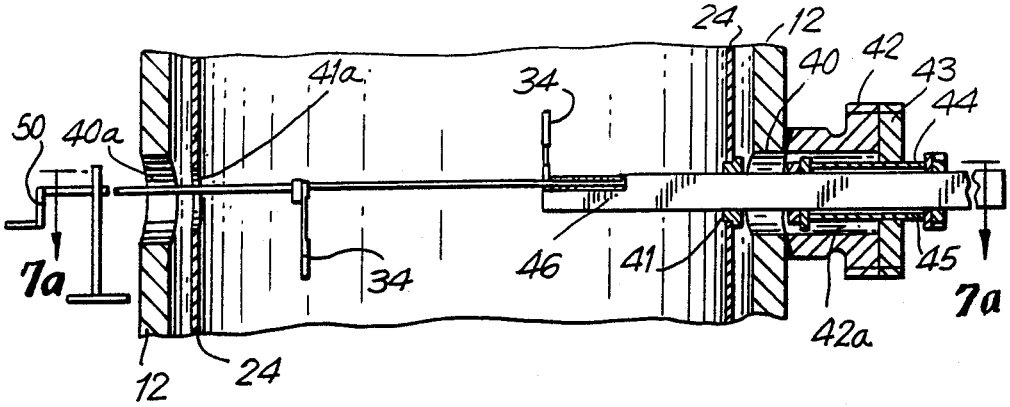
FIGS. 7 and 7*a* show partial vertical and horizontal sectional views of the suppressor blades being installed onto the rods and rotated upwardly into position between the diagonal batwing supports for the tubes.
Figure 7A:
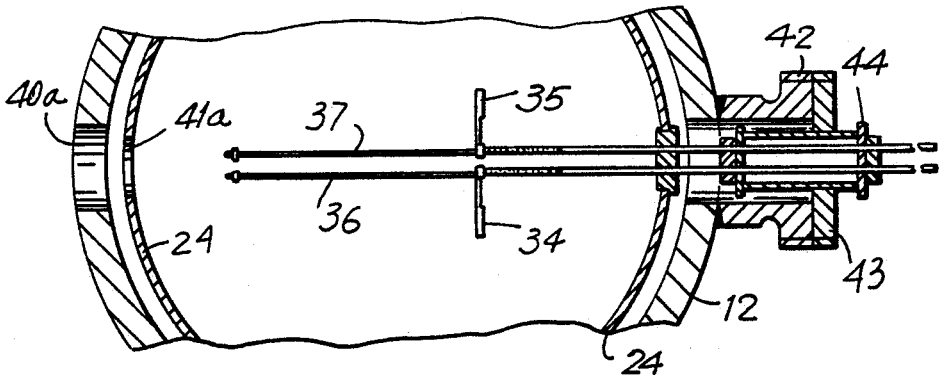

As the next step, the batwing suppressor blades 34, 35 are each inserted singly through the second openings 40*a* in the vessel wall 12 and second opening 41*a* in the shroud 24 by use of a special push/twist tool 50, as is generally shown at the left side of FIGS. 6 and 7. The batwing suppressor blades 34, 35 which each have a length exceeding the diameter of opening 41*a*, are each first inclined sufficiently so as to be inserted through the openings 40*a* and 41*a*, and are also guided by the tool 50 onto either keyed extension support rod 36 or 37 and key 36*a* or 37*a* of each rod. The suppressor blades 34, 35 are each pushed inwardly into the vessel 10 until they bottom against shoulder 46*a* of the step block 46, or against shoulder 47*a* of step block 47, and are then rotated by the tool 50 outwardly and upwardly until the blades are each inserted between the adjacent batwing support structures 30. The dual support rods 36, 37 are each then indexed forward guide block unit 44, so that slot 34*a* or 35*a* in each suppressor blade 34, 35 slips onto the longitudinal keyed portions 36*a* or 37*a* of the rod 36 or 37. Thus, as each batwing suppressor blade 34, 35 is installed in place on the guide rod, the step blocks 46, 47 and attached extension rods are indexed forward horizontally into the vessel interior by use of the guide block unit 44, as shown by FIGS. 7 and 7*a*. The guide blocks unit is indexed into the vessel using a separate jack screw mechanism (not shown). Index marks are provided on the guide block unit 44 to aid in determining the proper axial movement required.

Figure 8:
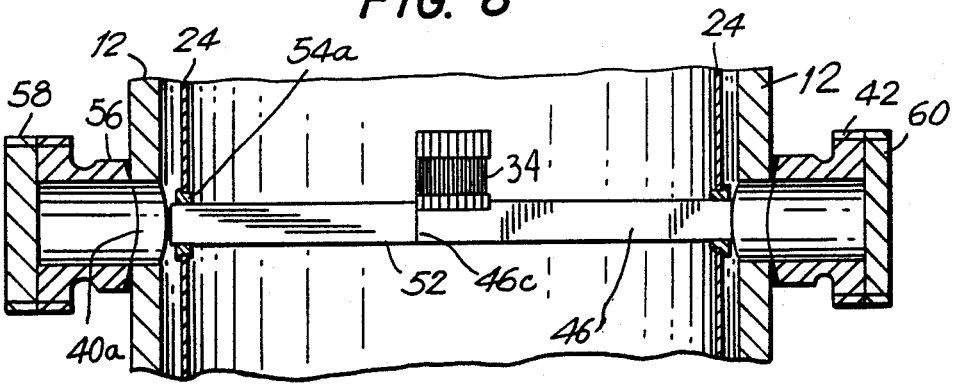
FIG. 8 shows a vertical sectional view of the vessel with the batwing suppressor blades all installed into position on the guide rods and the vessel openings closed with blind flanges.

After all the batwing suppressor blades 34, 35 have been installed in place on the keyed guide rods and rotated upwardly into position between adjacent batwing supports 30 as shown in FIGS. 4 and 8, a clamp block 52 is inserted through the openings 40*a* and 41*a* and is bolted in place against the ends 46*c* and 47*c* of the dual step blocks 46 and 47, respectively. A shroud plug 54*a* is then welded in place in the shroud opening 41*a* of shroud 24. Next, a nozzle/flange 56 which is similar to nozzle/flange 42 is sealably welded onto the vessel wall 12 in alignment with the openings 40*a* therein. A blind flange 58 is then bolted pressure-tightly onto the nozzle/flange 56. The guide block assembly 44 is removed from the first nozzle/flange 42, and a blind flange 60 is bolted pressure-tightly onto the nozzle/flange 42, as seen in FIG. 8. The installation of the batwing support vibration suppressors 34, 35 within generator vessel 10 to prevent vibrations of the batwing spacer supports 30 is now complete.

This invention will be further described by the following example of a typical pressurized steam generator vessel for a nuclear power plant, which example should not be construed as limiting the scope of the invention.

EXAMPLE

A steam generator is constructed having the following characteristics and dimensions:

| | |
|---|---|
| Vessel height, ft. | 100 |
| Vessel outer diameter lower portion, ft. | 10–12 |
| Total heat exchanger U-tubes | 25,000 |
| Tube outside diameter, in. | 1.c |
| Number batwing supports | 50 |
| Batwing length, in. | 12–18 |
| Batwing thickness, in. | 0.125 |
| Suppressor blade length, in | 12–18 |
| Suppressor blade thickness, in. | 1.0 |

For installation of the batwing vibration suppressor blades, the generator vessel is first provided with dual openings each 14 inch diameter which are cut in the vessel cylindrical wall lower portion and inner shroud on opposite sides of the vessel, the openings being in horizontal alignment with each other. After inserting dual step blocks and extension rods through one opening in the vessel wall, the batwing vibration suppressor blades are each inserted through the other opening in the vessel wall and are installed onto the dual extension rods provided within the central open portion of the vessel tube bundle by using a push/twist tool. Each suppressor blade is installed onto the extension rod and the blade rotated outwardly and upwardly into place and the blade slot is slid over the rod elongated key. After receiving each suppressor blade, the extension rods are then indexed forward by a distance equal to the blade thickness, this procedure is repeated until all the blades have been installed.

After all the vibration suppressor blades have been installed in place onto the extension rods and between the adjacent batwing spacer supports, a clamp block is placed against the step blocks and is clamped into place. Then a second nozzle flange is welded into place in the other opening, which is closed by a bolted blind flange to complete the installation.

Although this invention has been described broadly and in terms of a preferred embodiment, it will be understood that modifications and variations can be made all within the spirit and scope of the invention, which is defined by the following claims.

We claim:

1. A pressurizable vapor generator assembly including multiple tubes and having a tube support vibration suppression device for preventing induced vibrations of the tubes therein, comprising:

(a) a pressurizable vessel containing a plurality of U-bend shaped tubes connected to a header at the vessel lower end;

(b) a plurality of spacer supports each attached at its lower end to a support means, said spacer supports being oriented to extend between adjacent said U-bend tubes at their upper portion;

(c) first and second nozzle/flanges each welded onto opposite sides of said vessel around an opening in said vessel in horizontal alignment with each other and at a level below said spacer supports, said first nozzle/flange containing a guide block unit;

(d) a step block unit having dual extension support rods extending through an opening in said guide block unit into the central portion of said vessel;

(e) a plurality of parallel suppressor blades placed on said dual extension rods and oriented between said spacer supports;

(f) a clamp block inserted through said second opening and placed against said step block unit and clamped into place; and (g) a blind flange covering said first and second nozzle/flanges, whereby said parallel suppressor blades are each inserted and retained between said adjacent spacer supports to effectively stabilize the spacer supports and tubes from induced vibrations during operation of the generator.

2. The assembly of claim 1, wherein said suppressor blades installed in the central portion of the vessel tubes each have length greater than those blades installed nearer the nozzle/flanges of the vessel.

3. The assembly of claim 1, wherein said suppressor blades are each fixedly attached to an extension support rod in said step block unit by an elongated key inserted into a slot in each suppressor blade.

4. The assembly of claim 1, wherein said suppressor blades have openings provided therein to minimize weight of the blades.

5. The assembly of claim 1, wherein 20–50 suppressor blades are provided on said dual extension support rods between said spacer supports.

6. In a vapor generator assembly having a plurality of vertically-oriented U-bend tubes each attached to a lower header of a pressurizable vessel and supported at their upper end by diagonal spacer supports, wherein the improvement comprises a vibration suppression device including:

(a) dual nozzle openings provided in horizontal alignment with each other in the vessel wall on opposite sides of the vessel, said openings each being covered by a nozzle/flange, a first said nozzle/flange having a guide block unit installed therein;

(b) at least one step block unit having an integral elongated support rod installed into the vessel through said first nozzle/flange;

(c) a plurality of suppressor blades each having key slots and inserted through a second opening in said vessel wall onto said support rod and rotated so that blade slots engage an elongated key on said support rod;

(d) a clamp block inserted through said second opening onto said support rod and attached in place against said step block to clamp said suppressor blades firmly in position; and (e) a second nozzle/flange welded onto said vessel wall, whereby said stop block and support rod are first inserted into the vessel through said first nozzle/flange and the suppressor blades are each inserted into the vessel through the second opening and sequentially rotated into position between adjacent diagonal spacer supports using a push/twist tool, so as to stabilize the spacer supports against flow-induced vibrations within the generator vessel.

* * * * *